US005874713A

United States Patent [19]

Cydzik et al.

[11] Patent Number: 5,874,713

[45] Date of Patent: Feb. 23, 1999

[54] SINGLE TURN INDUCTION HEATING COIL

[75] Inventors: Edward A. Cydzik, Foster City; Peter Mark Godfrey, Union City, both of Calif.

[73] Assignee: Raychem Corporation, Menlo Park, Calif.

[21] Appl. No.: 889,454

[22] Filed: Jul. 8, 1997

[51] Int. Cl.[6] ..... H05B 6/10; H05B 6/40

[52] U.S. Cl. ..... 219/633; 219/634; 219/635; 219/672; 219/674

[58] Field of Search ..... 219/633, 634, 219/635, 636, 659, 670, 672, 673, 674, 676, 677

[56] References Cited

U.S. PATENT DOCUMENTS

| | | | |
|---|---|---|---|
| 3,238,346 | 3/1966 | Savko | 219/633 |
| 3,631,524 | 12/1971 | Denner | 219/670 |
| 3,665,138 | 5/1972 | Edge et al. | 219/611 |
| 3,689,727 | 9/1972 | Morris | 219/674 |
| 3,699,302 | 10/1972 | Griffith | 219/639 |
| 4,300,031 | 11/1981 | Reboux et al. | 219/670 |
| 4,853,510 | 8/1989 | Mohr et al. | 219/672 |
| 4,972,042 | 11/1990 | Seabourne et al. | 174/23 R |
| 5,214,258 | 5/1993 | Akers | 219/645 |
| 5,378,879 | 1/1995 | Monovoukas | 29/634 |
| 5,630,958 | 5/1997 | Stewart, Jr. et al. | 219/670 |

*Primary Examiner*—Philip H. Leung
*Attorney, Agent, or Firm*—Herbert G. Burkard

[57] ABSTRACT

A single turn induction heating coil provides a varied magnetic flux density for heating a portion of a load having a thermally and magnetically responsive sealant and tubing. The varied interior diameter of the cylindrical coil structure increases the magnetic flux density at the open ends of the coil or wherever desired, causing the ends of the magnetically responsive materials contained within the coil to be heated at a rate comparable to the middle portion of the coil. Consequently, the sealant and tubing recover faster and more uniformly avoiding the high incidence of tubing "flare up" or "flip back" common with typical single or multi-turn induction coil heaters. In the preferred application, heating produces a complete fluid block in a cable load section within the coil without overheating or damaging the load.

20 Claims, 3 Drawing Sheets

SINGLE TURN INDUCTION HEATING COIL

FIELD OF THE INVENTION

This invention relates generally to induction heating devices and, more particularly, to bundle blocking induction heating devices employing single-turn induction coils for uniform heating and recovery of heat recoverable tubing.

BACKGROUND OF THE INVENTION

In fabricating cables and harnesses containing a plurality of wires, it is desirable to provide fluid blocks to prevent the passage of fluids, such as water, along the cables. The problem of fluid passage arises in various industrial and commercial applications where cables are used, such as the automotive and telecommunications fields. In cable assemblies used in automobiles, for example, it is important to prevent moisture from migrating along the wires in the cable to various electrical components in different parts of the automobile. It is also desirable to prevent the passage of moisture, fumes and noise through the cable from the engine compartment to the passenger area.

Various techniques have been employed to deal with this problem. In the automotive field, wire harness assemblies are sometimes arranged with "drip loops" which consist of U-sections of the wires hanging down so that water passing along the wires will drip off at the bottom of the U-section. Obviously this is only a partial solution to the problem.

One desirable technique is to provide a packing or sealant around the wires in a protective rubber sleeve, which is designed to form a complete fluid block when heated. This technique and recent variations of the packing or sealant element is described in detail in U.S. Pat. Nos. 4,972,042 and 5,378,879 issued to Seabourne et al. and Monovoukas, respectively, and U.S. patent application Ser. No. 08/806,183, filed Feb. 25, 1997 by Rodkey et al., each assigned to the same assignee as the present application and incorporated herein by reference in their entirety.

The Seabourne patent discloses the use of fusible polymeric sealant, such as hot-melt adhesives or thermosetting adhesives, in a heat-shrinkable covering, tubing, or sleeve surrounding the cable wires. The application of heat to this assembly causes the adhesive to melt and surround the wires, forming a block upon cooling. Epoxy sealant may also be utilized, in which the application of heat facilitates curing and formation of a permanent fluid block in the cable.

Since this technique requires the application of heat to the assembly in a controlled manner to provide a satisfactory blocking structure, both the temperature of the assembly and the heating time must be carefully monitored. Excessive temperatures can cause damage to the cable wires or insulation, as well as the protective covering and sealant. On the other hand, if the heating temperature is too low, the blocking seal may not form completely and the block will be ineffective to prevent fluid passage. Ideally the heating should be uniform throughout the cable block to avoid hot spots and cold spots in the sealant.

To help provide the necessary uniform induction heating process, the Monovoukas patent discloses a technique of distributing ferromagnetic particles within a packing or sealant material, such as polymeric sealant. When ferromagnetic particles are added to this electrically non-magnetic and non-conductive material, it may be heated by magnetic induction heating by exposing it to high frequency alternating electromagnetic fields. The temperature of the ferromagnetic particles increases until the particles reach their Curie temperature, and the particles are self-regulating at that temperature. As disclosed in the Monovoukas patent, this technique may be used in the fabrication of sealant blocks in wire cable and harness assemblies.

The Rodkey et al. patent application modifies the wire harness structure of the Seabourne patent by providing a wire harness in a comb-like structure. The comb harness eliminates a cannonballing effect which occurs when three wires nest together, creating interstices which form a leak path between them.

FIG. 1 illustrates an example of a wire bundle 2 having a harness comb sealant 4 and a heat recoverable tubing 6 similar to those described above. Once the bundle is heated by the appropriate induction coil heating process, the structure will provide a bundle block for preventing any liquids or fumes from passing through the wire bundle.

Induction heating is a widely used heating method for applications requiring precise heating control. U.S. Pat. No. 5,630,958 by Stewart, Jr. et al., having the same assignee of the present invention, and which is incorporated herein by reference in its entirety, discloses a conventional multi-turn induction coil for heating a wire bundle block assembly as illustrated in FIG. 1 and described above. More specifically, this patent describes the use of a multi-turn "U" shaped coil having a movable flux concentrator to enhance the uniformity of heating in a load received laterally to the coil structure. An alternating current source having a high frequency (MHz) drives the coil to generate a high magnetic flux density in the load.

When multi-turn coils are employed in heating loads as illustrated in FIG. 1, the tubing 6 takes the most amount of time to recover. This duration is usually two to three times the duration needed to melt the comb adhesive 4. Consequently, although the coil will heat the load to produce the desired bundle block, because of the extra heat provided to the load, other components of the load exposed to the magnetic field may be damaged.

For example, in a typical wire bundle, copper wires coated with insulation are present and the copper is inductively heated. The copper is not self-regulating in temperature because it does not have a Curie temperature like ferromagnetic materials. As a result, the copper continues to heat as power is continuously applied, the insulation surrounding the copper continues to heat due to heat generated by the copper, and wire becomes damaged.

The window period in which adequate heating of the article occurs without damage to components may be extremely small or nonexistent. This problem is addressed in commonly owned U.S. patent application Ser. No. 08/403,032, filed Mar. 13, 1995, U.S. Pat. No. 5,672,290 entitled "Power Source and Method for Induction Heating of Articles" by Levy et al., which is assigned to Raychem Corporation, the same assignee of the present invention, and is incorporated herein by reference in its entirety. This technique decreases the induction heat generated in the load wires by adjusting the power levels provided to the coil after a predetermined time. The time and power level adjustment are predetermined by factors such as the bundle size, and the Curie temperature of the ferromagnetic particles used in the bundle comb and tubing.

Through experimentation by the applicants, single-turn coils have proven to be very efficient in heating the adhesive comb 4 and heat-shrinkable tubing 6 by electromagnetic induction. FIG. 2 illustrates a single-turn inductive coil 10. The coil 10 includes an interior diameter 12 and a length 14 comparable to the portion of the load (not shown) to be heated. By driving the single turn coil 10 with an AC source having a low frequency in the kHz to low MHz range, the tubing recovery time is significantly reduced (it approaches the time needed to melt the combs), which in turn, increases the installation window for the product by reducing the total bundle block install time.

The increase in performance is attributable to the existence of a much more uniform longitudinal and radial magnetic flux density in the coil as compared to the multi-turn coil. However, as shown in FIG. 3, as a result of the dynamics of tubing recovery, the ends of the tubing 6 "flare up" 16 and then "flip back" 18 over the tubing 6 when the wire bundle 2 is heated in the coil 10 (the wire bundle has a comparable size to the coil). This effect is due to the low magnetic flux density applied to the two ends of the heat-shrinkable tubing 6 causing a slower recovery rate at the ends of the tubing 6 rather than at the middle portion.

SUMMARY OF THE INVENTION

It has now been discovered that a single-turn induction coil driven at a low AC frequency can be configured to increase the magnetic flux density at the ends of the coil to cause the ends of the heat-shrinkable tubing or sleeve to recover at the same rate as the central portion, thus eliminating "flare-up" and "flip back".

It is a feature of this invention to provide a single-turn induction coil for uniformly heating a load at low magnetic flux densities, without causing overheating or damage to the load.

It is another feature of the invention to provide a single-turn induction coil for heating a load, in which the heating efficiency is improved and the heat treatment time is decreased.

It is yet another feature of this invention to provide a single-turn induction coil that will provide a magnetic induction heating structure for load, in which the coil has lateral access to the load so that the load may be heated without threading it through the coil.

In accordance with one aspect of the present invention, a portable inductive coil is provided by dividing the coil longitudinally into two portions and hinging one side so that the other side can receive loads from a side perpendicular to the planar cylindrical surface of the coil.

In accordance with another aspect of the invention, a protective sleeve is provided within the coil for guiding the load and protecting the user from the heated coil.

Another aspect of this invention is a liquid recirculation interior to the coil to help displace the heated coil.

BRIEF DESCRIPTION OF THE DRAWINGS

The preferred embodiments of this invention, illustrating all their features, will now be discussed in detail. These embodiments depict the novel and nonobvious induction coil of this invention shown in the accompanying drawings, which are included for illustrative purposes only. These drawings include the following figures, with like numerals indicating like parts.

DETAILED DESCRIPTION OF THE INVENTION

Figure 2:
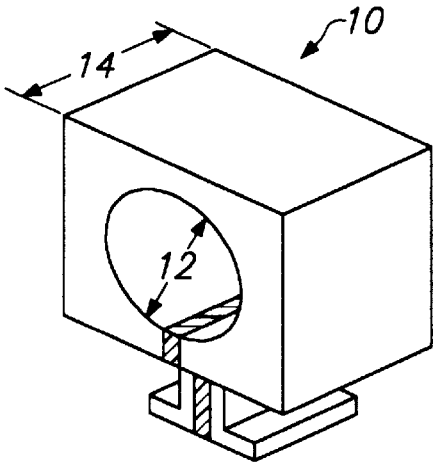
FIG. 2 PRIOR ART
FIG. 2 is a perspective view of a single coil cylindrical structure for heating the load of FIG. 1.
Figure 4:
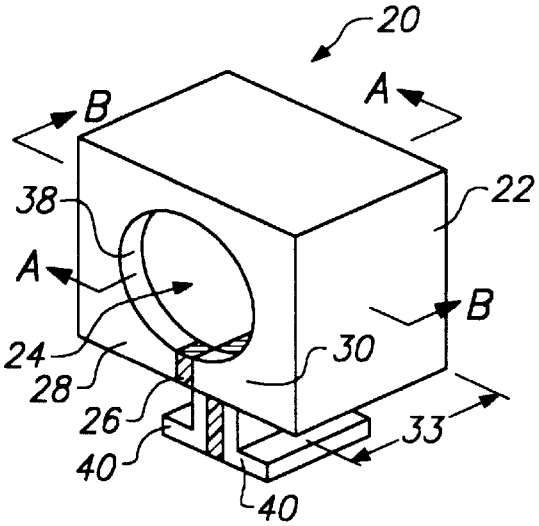
FIG. 4 is a perspective view of the preferred single-turn inductive coil structure of the present invention.
Figure 5A:
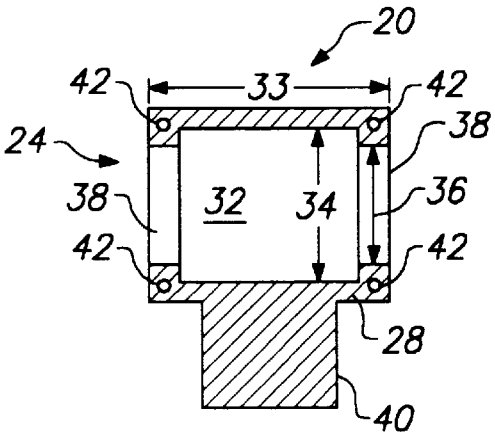
FIG. 5A and 5B are front and side cross sectional views of the inventive inductive coil of FIG. 4.
Figure 5B:
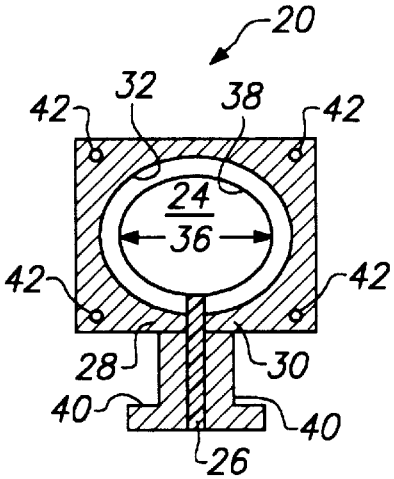

FIG. 4 illustrates an induction coil structure of the present invention for heating a portion of a load containing a thermally response material. In the most simplistic form, the single turn induction heating coil 20 is formed from a copper alloy block 22 having a hole 24 provided through the block 22. Although coil 20 is shown in the form of a block, as seen in FIGS. 2, 4 and 5, the outside of the coil may be constructed in any desired configuration. A spacer 26 positioned along the length of the block 22 defines the coil terminals 28, 30 for coupling a driving power source (not shown) to the coil 20. The power source is omitted from the drawings for simplicity. As further illustrated in the elongated front and side cross-sectional views of FIGS. 5A and 5B, the hole 24 of the coil 20 provides a varied interior diameter. Preferably, the varied diameter is characterized by a central portion 32 having a greater first interior diameter 34 than the second interior diameter 36 provided at the distal ends 38 of the coil 20. The operational significance of the varied diameter within the coil will be discussed below.

The power source connects to the coil terminals 28, 30 by legs 40. To insure that the alternating current provided by the power source can flow through the coil 20 to produce the necessary magnetic fields, non-conductive and electrically non-magnetic material, such as a polymeric sealant, fills the spacer 26 and between the legs 40.

Because of the natural conductive properties of copper, the coil will heat up while the driving source is active. Consequently, as illustrated in the cut-away views of FIGS. 5A and B, fluid circulation holes 42, provided within the coil, may be incorporated to help dissipate heat created within the powered coil. The fluid circulation holes 42 connect to input and output valves (not shown) on the exterior surface of the coil 20, which in turn connect to a pump for circulating fluid through the active coil. The fluid may be circulated in all, a portion, or none of the coil.

It will be appreciated by persons of skill in the relevant art that the coil of FIG. 4 can be modified to accommodate numbers loads of various size and shape. For example, the cylindrical interior structure of the coil could be square, rectangular or elliptical to best complement the shape of the load. In turn, if the structure of the coil changes, the size and shape of the load will vary, and so will the amount of heat generated by an active coil. Consequently, the interior recirculation path will change such that the desired heat is displaced within the active coil. Such a change in the coil recirculation path could include a radiator or chamber-like interior path to displace more heat or even the elimination of the coil recirculation path in the appropriate application. With respect to the induction coil being made from cooper, it will be recognized that nearly any conductive material may be used if the known properties of the material are best suited for the heating process and application.

Figure 1:
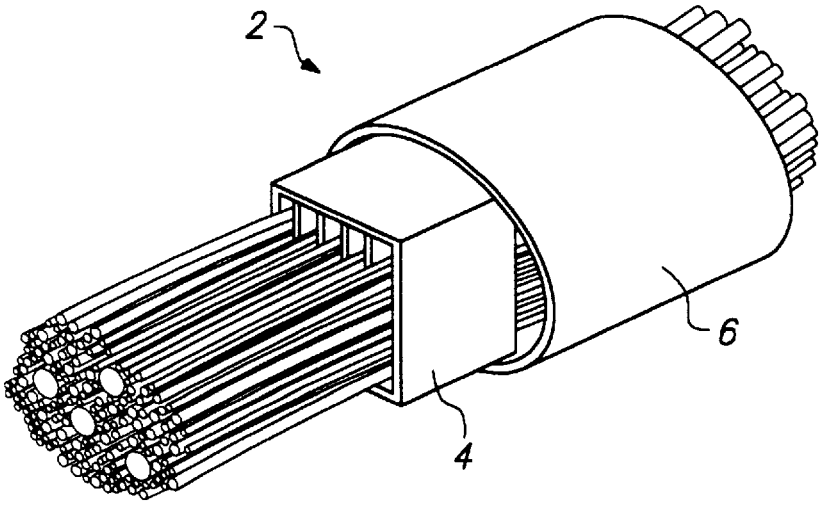
FIG. 1 PRIOR ART
FIG. 1 is a semi-exploded perspective view illustrating a conventional load to be heated by an inductive heating coil.
Figure 3:
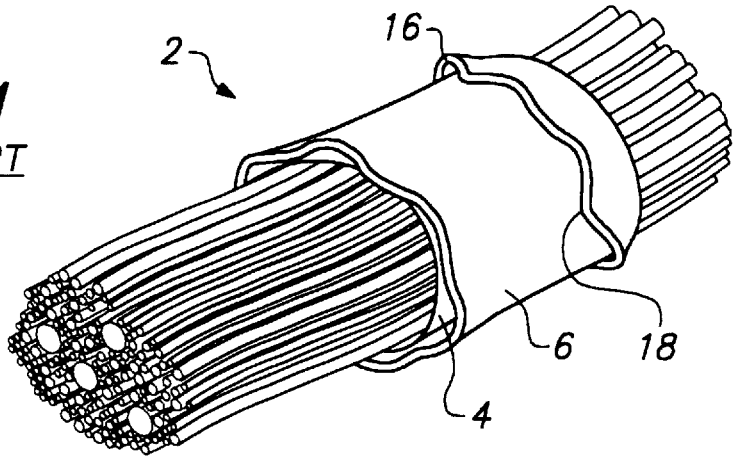
FIG. 3 PRIOR ART
FIG. 3 is a perspective view showing resultant wrap heated by the coil of FIG. 2 illustrating the undesirable "flare-up" and "flip back" characteristic associate with the coil structure of FIG. 2.

An example of a load for the present inventive induction heating coil is shown in FIG. 1. It will be appreciated by a person of skill in the art, that the load could consist of any configuration including a heat recoverable article. As mentioned earlier, the load 2 consists of a wire bundle block having comb sealant 4 and heat recoverable tubular sleeve 6. Preferably, the comb 4 is composed of a non-conductive and an electrically non-magnetic polymeric material having magnetic particles dispersed therein as disclosed by the above referenced mutually assigned patent application by Rodkey et al., and issued patent by Monovoukas. The heat recoverable tubing sleeve 6 loosely fits over the comb 4, including bundled wires, and may be folded over onto itself for ease of handling. Sleeve 6 includes an adhesive as an interior lining which, like the comb, preferably includes non-conductive and non-magnetic material particles dispersed therein, as described in Monovoukas. For the most effective heating process, the length and diameter of the heat recoverable tubing 6 before recovering, will be comparable to the interior diameter 36 of the inductive coil of the present invention. In other words, the length of the tubing 6 before heating, will be equal to or smaller than the length 33 of the coil 20.

After positioning the tube 6 over the comb 4, the resultant structure is received by the coil 20 and the coil becomes active to heat the load. More specifically, once the load 2 is received within the coil 20 such that the ends of the tubing are positioned in the vicinity of the distal ends 38 of the coil, i.e., in the most preferred embodiment, the portion of the coil having reduced interior diameter, the power source provides an alternating current source, preferably having a low frequency in the range of 50 to 2,000 kHz, more preferably between 500 and 1,100 kHz. The AC source moves through the inductive coil between the terminal ends 28, 30 generating a magnetic field having two magnetic flux densities due to the varied interior diameters 34, 36 of the coil. Although both magnetic flux densities extend outwardly towards and into the load, the smaller interior diameter 36 at the distal ends 38 of the coil generates a higher magnetic flux density.

Figure 6:
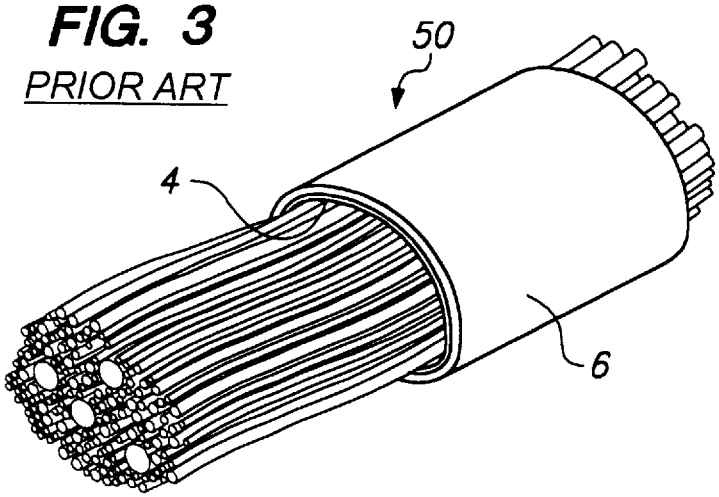
FIG. 6 is a perspective view of the load of FIG. 1 heated by the inventive coil structure as shown in FIG. 4.

As discussed earlier with reference to the patent by Monovoukas, the heat generated within the load is due to the magnetic particles within the comb and tube interacting with the magnetic field. More specifically, because of the conductive nature and the eddy currents and hysterisis effects associated with the particles when bombarded with the low density magnetic field, the load is heated. Thus the uniformly heated load components provide the desired bundle block 50 as illustrated in FIG. 6. Resultant bundle block 50 will prevent the passage of fluids, such as water, and/or vapors, such as car engine exhaust, along or through the cables when positioned in an automobile, boat, on the ground, or elsewhere.

It will be appreciated by persons reasonably skilled in the relevant art that a magnetic field generated by a single turn coil having a single interior diameter attains a maximum flux density in the central portion of the coil, and that the magnetic field decreases near the distal open ends due to the outward extents of the field lines protruding away from the coil chamber.

In other words, when the load 2 of FIG. 1 is located inside the single interior diameter coil of FIG. 2, the field produced by the coil alone is stronger in the central portions of the load and weaker in the outer portions. This variation of the field strength results in the undesirable "flare-up" and "flip-back" characteristics associated with a single coil structure having only a single interior diameter.

The present device provides distal portions that are stepped to form a smaller interior diameter relative to the central portions of the coil. This stepped region increases the magnitude of the magnetic field in the region of the coil opening and heats the distal portions 38 of the load. This increase in the field strength, i.e., flux density, at the distal ends of the coil provides a consistent heating process to the load within the coil and prevents any "flaring up" or "flipping back" associated with a heated shrinkable tubing. This increase is designed to offset the variation of the field strength near the openings of the coil that would be produced by a single turn coil having only a single interior diameter. Thus, the increased flux density at the ends 38 of the coil 20, causes the ends of the load, i.e., the tube 6 of FIG. 1, to be heated at a rate comparable to the middle portion of the load.

The precise parameters of the heating structure depends on the desired mode of operation. It will be recognized by persons of ordinary skill in the relevant art that the above description of the stepped interior diameter of the single turn coil does not necessarily need to be stepped. If desired, a similar effect can be obtained by a ramp or wave-type change in the interior diameters from the central potions to the outer distal portions of the coil.

It is within the scope of the present invention to construct the varied interior diameter having a reduced diameter portion intermediate the distal end portions 38 of the coil so as to provide an increased flux density at an alternate location, depending upon the configuration of the load to be heated.

Figure 7:
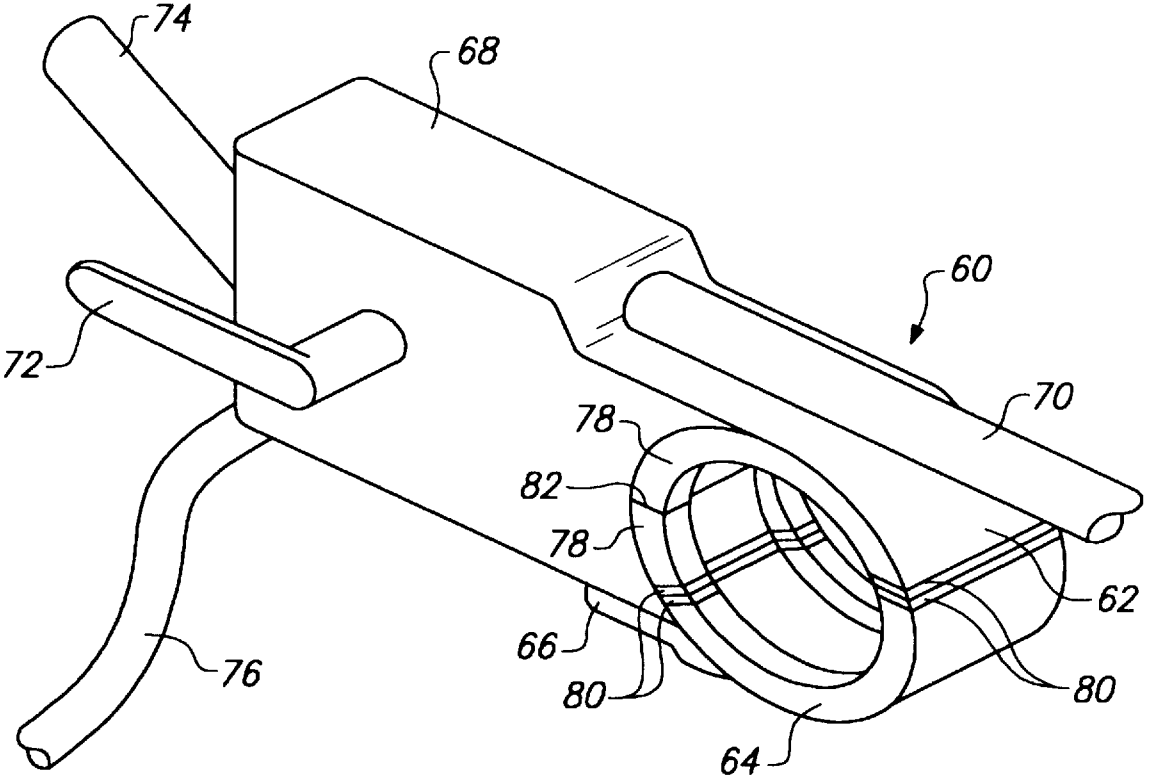
FIG. 7 is a perspective view illustrating the preferred inductive coil of FIG. 4 modified to provide a portable inductive coil for receiving loads from the longitudinal side of the coil.

Now that an effective and efficient device for forming wire bundle blocks has been invented, consideration must be given to the best way for implementing such a device that will not only be functional, but also portable and easy to use in the appropriate market place. FIG. 7 illustrates a preferred apparatus for housing the coil of the present invention which retains the functionality of the inventive coil, and adds the necessary portable and usable aspects demanded by the market. With that in mind, the coil of FIG. 4 was divided into two pieces and hinged at one end such that a load can be received from the side by opening and closing the coil. More specifically, the modified coil 60 provides first and second portions 62, 64 coupled by a hinge 66. High current contacts in the form of conductive caps or capping plates 80, preferably constructed of silver, mount to the exposed end portions of the divided coil 60 to help insure the conductive path between the terminals 78. To insulate the conductive terminals 78 from each other, an electrically non-magnetic and non-conductive material 82 finishes the interior diameter of the coil such that a current path is present through the coil 60. The hinge 66 secures the coil 60 to a lightweight housing 68 and can be opened or closed manually by a lever 72 positioned on the housing 68. The housing also comprises a mounting rod 70, a stabilizing handle 74, and a supply hose 76.

The stabilizing handle allows the user to carry or move the coil 60 to a desired location on a production board (not shown) which holds the portion of the load to be heated. At the desired location, the user will open the coil by the lever 72 and insert the mounting rod 70 into a receiving tube (not shown) to secure the coil to the production board. With the load in place, the coil is closed and ready to be powered.

The supply hose 76, coupled to the housing 68, provides the necessary power source to drive the coil and the recirculating fluids for cooling the driven coil, if desired. Modified coil 60 may be constructed such that supply hose 76 is disposed within stabilizing handle 74. It will also be appreciated by a persons of ordinary skill in the art that the supply hose 76 could be replaced by adding a plug type structure in the mounting rod and tube for providing the coil with the necessary power and recirculating fluids.

When manufacturing the side entry coil 60 of FIG. 7, special consideration should be taken to make sure that the closed coil provides the necessary conductive path during operation. Consequently, in addition to the conductive caps 80, the hinges 66 or the lever 72 should having locking means for securing the coil in the closed position.

The side entry heating coil 60 of FIG. 7 provides the same varied interior diameter structure as the heating coil of FIG. 4. In addition, either coil can be powered by the same power source to provide the same resultant uniform heating operation. Thus, the operation for heating the load is identical to the first embodiment disclosed with reference to FIG. 4, however, after the necessary time for heating the load has elapsed, the lower portion 64 of the coil 60 is opened by lever 70 and the load is removed to provide the desired bundle block as illustrated in FIG. 6.

The following example further illustrates the practice of this invention.

EXAMPLE

This example, for the instant invention, used the apparatus of FIG. 7 in the process of induction coil heating a portion of a 1½" diameter wire bundle containing 101 wires having a thermally responsive sealant and tubing. More specifically, the wire bundle included one 6 gauge, three 10 gauge, thirteen 14 gauge, and eighty-three wires of gauge weights distributed between 16, 18 and 20. All wires had thin-walled PVC insulation and were contained by comb sealant structures as described in U.S. patent application Ser. No. 08/806,183, referred to above. The entire assembly was enclosed in heat recoverable tubing having a diameter of approximately 52 mm and an interior sealant coating. Both the heat recoverable tubing interior coating and the comb sealant structures where fabricated of non-conductive and electrically non-magnetic material, such as a polymeric material, having dispersed ferromagnetic particles as described in U.S. Pat. No. 5,378,879 by Monovoukas, as disclosed above.

After positioning, opening, mounting, and closing the coil of FIG. 7 to encompass the portion of the load to be heated, a driving AC power supply having a frequency of 937 kHz was supplied to the coil for twenty seconds. The magnetic fields generated by the powered coil uniformly heated the components of the load to provide a liquid and vapor tight wire bundle blocking as shown is FIG. 6. The coil was dimensionally comparable to the load such that the distal ends of the tubing were centrally positioned in the center of either distal step of the coil before the coil was powered, and slightly within the stepped regions after the tubing had recovered.

Numerous other tests have been performed with cable bundle sizes anywhere from ¾" diameter to 1½" diameter using various comb profiles and tubing diameters including 25 mm, 35 mm, 40 mm, and 52 mm. Additionally, depending on the cable bundle size, the appropriate AC source having a frequency between 900 kHz and 1,000 kHz was used to generate the necessary magnetic fields within the coil to heat the load.

As a result in all tests, the applicants found that employing a single turn heating coil having a varied diameter as shown in FIGS. 4 or 7, wherein the approximate geometry of the load was comparable to the coil, the tubing and comb sealant recovered at nearly the same rate of time. More particularly, the recovery rate of the tubing was significantly reduced, thereby increasing the insulation window for the product by reducing the total block install time, and eliminating the problem of "flare-up" and "flip-back" discovered with single turn induction coil having only a single diameter. This performance increase, attributable to the existence of a much more longitudinal and radial magnetic flex density in the varied diameter single turn induction coil, has provided a means for heating a portion of a load having a thermally responsive material with a higher efficiency and efficacy than any single or multi-turn induction heating coil used today.

It will be understood that the above-described arrangements of apparatus and the methods therefrom are merely illustrative of applications of the principles of this invention and many other embodiments and modifications may be made without departing from the spirit and scope of the invention as defined in the claims.

What is claimed is:

1. An induction heating apparatus comprising:

a single turn coil having a cross-sectional dimension which is variable along the longitudinal length of the coil and which provides an open-ended chamber area, said chamber area surrounding a portion of an article which includes a heating load which contains a magnetically responsive material, said portion of said article having a length less than the length of said chamber area; and a power supply means coupled to said coil for driving alternating current through said coil, thereby generating a magnetic field extending outwardly towards said heating load to inductively heat said magnetically responsive material.

2. The apparatus of claim 1, wherein said cross-sectional dimension which is variable alone the longitudinal length of the coil further includes a first interior diameter being greater than a second interior diameter, said first interior diameter forming the central portion and said second interior diameter forming the distal open end portions of said chamber area.

3. The apparatus of claim 2, wherein said single turn coil is constructed of a first portion and a second portion, each of which have semi-circular interior surfaces, the first and second portions being coupled by a hinge.

4. The apparatus of claim 1, wherein said coil further includes an electrically non-conductive spacer extending from the interior through to the exterior of the coil and along the entire longitudinal length of said chamber area.

5. The apparatus of claim 1, wherein said coil is divided into first and second portions having separation lines which travel the longitudinal length of said coil, said portions being connected along one separation line by hinging means for providing side entry of said load.

6. The apparatus of claim 1 further including coil cooling means for displacing a portion of the heat generated by said driven coil.

7. The apparatus of claim 6, wherein said coil cooling means further includes a hollow chamber within said coil and being connected between an input and an output hole located on the surface of said coil.

8. The apparatus of claim 7 further including a recirculating pump for providing a liquid through said hollow chamber using said input and output hole.

9. The apparatus of claim 1, wherein said magnetically responsive material further includes non-conductive and electrically non-magnetic material containing magnetic particles that are conductive in the magnetic field due to eddy currents and hysterisis effects of the particles interacting with the driven coil.

10. The apparatus of claim 9, wherein said non-conductive and electrically non-magnetic material is polymeric material.

11. The apparatus of claim 1, wherein said magnetically responsive material comprises ferromagnetic particles.

12. An induction heating apparatus for heating a portion of a load containing a magnetically responsive material, said apparatus comprising:

a single turn coil having an open-ended chamber area for receiving and surrounding the magnetically responsive material of the load;

a power supply means coupled to said coil for driving alternating current through said coil, said driven coil generating a magnetic field extending outwardly towards said coil to inductively heat said magnetically responsive material; and heat controlling means for increasing the magnetic flux density at the distal ends of the received magnetically responsive material of said load.

13. The apparatus of claim 12, wherein said heat controlling means further includes a cross-sectional dimension which is variable along the longitudinal length of said coil.

14. The apparatus of claim 13, wherein said cross-sectional dimension which is variable along the length of said coil provides a stepped central portion having an interior diameter greater than the interior diameter of the distal ends of said coil.

15. A process for heating a portion of a heat load containing a magnetically responsive material, said process comprising the steps of:

providing a single turn coil having a cross-sectional dimension which is variable along the longitudinal length of said coil to provide an open-ended chamber area, said chamber area having a length greater than the length of the magnetically responsive material;

inserting the portion of the load to be heated within said chamber area; and generating a magnetic induction field within said coil in the load, whereby the distal portions of the magnetically responsive material are heated at a rate comparable to the middle portion.

16. The process of claim 15, wherein said step of generating a magnetic induction field further includes the step of connecting a power supply means to said coil, said power supply means generating an alternating current in said coil, thereby producing said magnetic field.

17. The process of claim 15, wherein said step of inserting the portion of the load further includes the steps of:

opening the coil by hinging means to provide two semi-circular domed portions;

inserting the load between the two portions from the opened side; and closing the opened coil.

18. The process of claim 15 further including the step of displacing heat generated from said driven coil by fluid circulation within said coil.

19. The process of claim 15, wherein the step of generating further includes the step of providing an alternating current having a frequency of about 50 to 2,000 kHz.

20. The process of claim 15, wherein the step of generating further includes the step of providing a greater magnetic flux density at the distal ends than at the central portion of said coil.

* * * * *